US009251641B2

(12) United States Patent
Kim

(10) Patent No.: US 9,251,641 B2
(45) Date of Patent: Feb. 2, 2016

(54) DRUG DISPENSING BOX AND CARTRIDGE HAVING MUTUALLY COUPLED STRUCTURE

(71) Applicant: JVM CO., LTD., Daegu (KR)

(72) Inventor: Jun Ho Kim, Daegu (KR)

(73) Assignee: JVM CO., LTD., Daegu (KR)

( * ) Notice: Subject to any disclaimer, the term of this patent is extended or adjusted under 35 U.S.C. 154(b) by 98 days.

(21) Appl. No.: 14/065,109

(22) Filed: Oct. 28, 2013

(65) Prior Publication Data

US 2014/0117038 A1 May 1, 2014

(30) Foreign Application Priority Data

Nov. 1, 2012 (KR) ..... 10-2012-0123147

(51) Int. Cl.

| | |
|---|---|
| ***G07F 11/60*** | (2006.01) |
| ***G07F 11/38*** | (2006.01) |
| ***G07F 11/24*** | (2006.01) |
| ***G07F 11/42*** | (2006.01) |
| ***G07F 11/46*** | (2006.01) |
| ***G07F 11/62*** | (2006.01) |
| ***G07F 17/00*** | (2006.01) |

(52) U.S. Cl.

CPC ..... *G07F 11/38* (2013.01); *G07F 11/24* (2013.01); *G07F 11/42* (2013.01); *G07F 11/46* (2013.01); *G07F 11/62* (2013.01); *G07F 17/0092* (2013.01)

(58) Field of Classification Search

CPC ..... G07F 11/46; G07F 11/60
USPC ..... 221/197, 11, 198, 129
See application file for complete search history.

(56) References Cited

U.S. PATENT DOCUMENTS

| | | | | |
|---|---|---|---|---|
| 3,039,838 | A * | 6/1962 | Koch, Jr. et al. | 384/21 |
| 3,658,394 | A * | 4/1972 | Gutner | 384/21 |
| 4,436,215 | A * | 3/1984 | Kleinert et al. | 220/533 |
| 4,664,289 | A * | 5/1987 | Shimizu et al. | 221/2 |
| 4,832,509 | A * | 5/1989 | Merrifield | 384/21 |
| 5,413,409 | A * | 5/1995 | Arai | 312/330.1 |
| 6,185,530 | B1 * | 2/2001 | Ittycheriah et al. | 704/255 |
| 6,616,010 | B2 * | 9/2003 | Yuyama et al. | 221/197 |
| 8,567,639 | B2 * | 10/2013 | Kim | 221/154 |
| 2010/0164337 | A1 * | 7/2010 | Yuyama | 312/209 |
| 2011/0172815 | A1 | 7/2011 | Kim | |

FOREIGN PATENT DOCUMENTS

| | | | |
|---|---|---|---|
| CN | 102670000 | A | 9/2012 |
| EP | 1 700 592 | A1 | 9/2006 |

(Continued)

*Primary Examiner* — Patrick Mackey
(74) *Attorney, Agent, or Firm* — Birch, Stewart, Kolasch & Birch, LLP

(57) ABSTRACT

Provided is a drug dispensing box and cartridge having a mutually coupled structure. The cartridge disposed on each of floors of a drug dispensing apparatus and connected to each of a plurality of drug dispensing boxes includes a cartridge housing comprising a lower housing supporting the drug dispensing box and a rear housing restricting entry of the drug dispensing box by a predetermined distance, a rail disposed along an entry path of the drug dispensing box on the lower housing; and a first data transmitting/receiving terminal connected to the drug dispensing box to transmit/receive data. A rail for guiding the drug dispensing box when the drug dispensing box and the cartridge are connected to each other may be provided to connect the drug dispensing box to the cartridge at a regular position.

14 Claims, 17 Drawing Sheets

(56) References Cited

FOREIGN PATENT DOCUMENTS

| | | | |
|---|---|---|---|
| EP | 1 701 313 | A2 | 9/2006 |
| EP | 2 168 877 | A2 | 3/2010 |
| EP | 2 500 878 | A1 | 9/2012 |
| JP | 2-162794 | A | 6/1990 |

* cited by examiner

DRUG DISPENSING BOX AND CARTRIDGE HAVING MUTUALLY COUPLED STRUCTURE

CROSS-REFERENCE TO RELATED PATENT APPLICATION

This application claims the benefit of Korean Patent Application No. 10-2012-0123147 filed on Nov. 1, 2012 in the Korean Intellectual Property Office, the disclosure of which is incorporated herein in its entirety by reference.

BACKGROUND OF THE INVENTION

1. Field of the Invention

The present invention relates to a drug dispensing box and cartridge having a mutually coupled structure, and more particularly, to a coupled structure between a drug dispensing box and a cartridge, which are components of apparatus for automatically dispensing drugs, unlike a conventional apparatus for manually dispensing drugs.

2. Description of the Related Art

In general, a dose of drug according to a patient's prescription may include various kinds and types of drugs. The dose of drug classified according to the patient's prescription may be transferred to the patient in a state of being contained in a basket.

Drugs to be contained in one basket are gathered into one basket from boxes, in which various kinds of drugs are contained, according to kinds and numbers of drugs written on a patient prescription. Then, the basket in which the corresponding drugs are gathered is transferred to the patient, and then, the patient takes the drugs gathered in the basket.

In conventional ways, to gather various drugs into one basket, medical experts such as pharmacists may manually select drugs according to a patient's medical prescription to take the selected drugs into the basket. Thus, it may be necessary to determine accuracy in the collection of the drugs again. There is possibility of occurrence of drug misadventure because it is difficult to secure accuracy in administration. Also, it takes a long time to gather drugs according to a patient's prescription because the gathering process is complicated to deteriorate working efficiency in addition to the possibility of the occurrence of the drug misadventure. Thus, studies with respect to methods and technologies for improving accuracy and efficiency in the gathering of drugs for each unit dose according to the patient's prescription to provide convenience of users such as pharmacists and previously prevent drug misadventure from occurring are needed.

SUMMARY OF THE INVENTION

The present invention provides a coupled structure between a drug dispensing box and a cartridge for mechanically fixing and electrically controlling the drug dispensing box within a drug dispensing apparatus.

The present invention also provides a mechanical power transmission control unit that operates to transmit or block external power.

The present invention also provides a fixing unit for firmly mechanically coupling a cartridge to a drug dispensing box.

The technical objects of the present invention are not limited to those described above, and it will be apparent to those of ordinary skill in the art from the following description that the present invention includes other technical objects not specifically mentioned herein.

According to an aspect of the present invention, there is provided a cartridge disposed on each of floors of a drug dispensing apparatus and connected to each of a plurality of drug dispensing boxes, the cartridge including: a cartridge housing including a lower housing supporting the drug dispensing box and a rear housing restricting entry of the drug dispensing box by a predetermined distance; a rail disposed along an entry path of the drug dispensing box on the lower housing; and a first data transmitting/receiving terminal connected to the drug dispensing box to transmit/receive data.

The rail may protrude upward with a predetermined length.

The rail may be provided in at least two, and the at least two rails may be disposed parallel to each other.

The first data transmitting/receiving terminal may have a protruding shape with a predetermined stepped portion forward from the rear housing.

The first data transmitting/receiving terminal may include a plurality of connecting pins on a lower end thereof.

The cartridge may further include a locking unit disposed on the cartridge housing to fix the drug dispensing box or release the drug dispensing box so that the drug dispensing box is separable.

The locking unit may include: a cam rotating about a predetermined rotation axis, the cam having a long radius portion and short radius portion in a radial direction with respect to the rotation axis; a locking unit body contacting an outer circumference surface of the cam, the locking unit body ascending when the locking unit body contacts the long radius portion of the cam and descending when the locking unit body contacts the short radius portion of the cam; and a hook part extending from a front surface of the locking unit body, the hook part ascending or descending together with the locking unit body.

The cartridge may further include a separation promotion part applying force to the drug dispensing box in a separation direction when the drug dispensing box is separated.

The separation promotion part may include: a first protrusion protruding from an upper end of the lower housing and exposed to the outside; and a first elastic member connected to the first protrusion, the first elastic member being pressed when the drug dispensing box is connected and providing restoring force the drug dispensing box in the separation direction when the drug dispensing box is separated.

According to another aspect of the present invention, there is provided a drug dispensing box connected to a cartridge, the drug dispensing box including: a dispensing box housing; a rail accommodation unit defined in a bottom surface of the dispensing box housing to guide dispensing box housing along an entry path of the cartridge when a rail of the cartridge is accommodated for the dispensing box housing to be connected to the cartridge; and a data terminal unit electrically connected to the cartridge to transmit/receive data into/from the cartridge.

The rail accommodation unit may be disposed to reach a rear surface of the dispensing box housing, thereby being exposed from the rear surface of the dispensing box housing.

The rail accommodation unit may further include an accommodation starting part having a width gradually increasing toward the rear surface of the dispensing body housing.

The data terminal unit may include: a terminal accommodation grove accommodating a data transmitting/receiving terminal of the cartridge; and a second data transmitting/receiving terminal disposed on a lower end of the terminal accommodation groove, the second data transmitting/receiving terminal being connected to the data transmitting/receiving terminal of the cartridge.

The drug dispensing box may further include a hanger part having a stepped groove shape so that a hook part of the cartridge is accommodated and hung.

The dispensing box housing may have a separation promotion accommodation groove in which a separation promotion part of the cartridge is accommodated.

The drug dispensing box may further include at least one gear receiving external power.

The drug dispensing box may further include a power transmission blocking unit restricting rotation of the gear or releasing the gear.

The power transmission locking unit may include: a rotation part including a first end alternately rotating in a direction of the gear and in a direction opposite to that of the gear with respect to a rotation shaft and a second end disposed on the other side of the first end to rotate in a direction opposite to the rotation direction of the first end; and a blocking unit body connected to the second end, the blocking unit body including a second protrusion inserted between teeth of the gear, wherein the blocking unit body is retreated together with the second end when the second end rotates in a direction opposite to that of the gear to allow the second protrusion to be separated from a space between the teeth of the gear.

The drug dispensing box may further include a second elastic member connected to the blocking unit body to provide elastic force to the blocking unit body in the direction of the gear.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
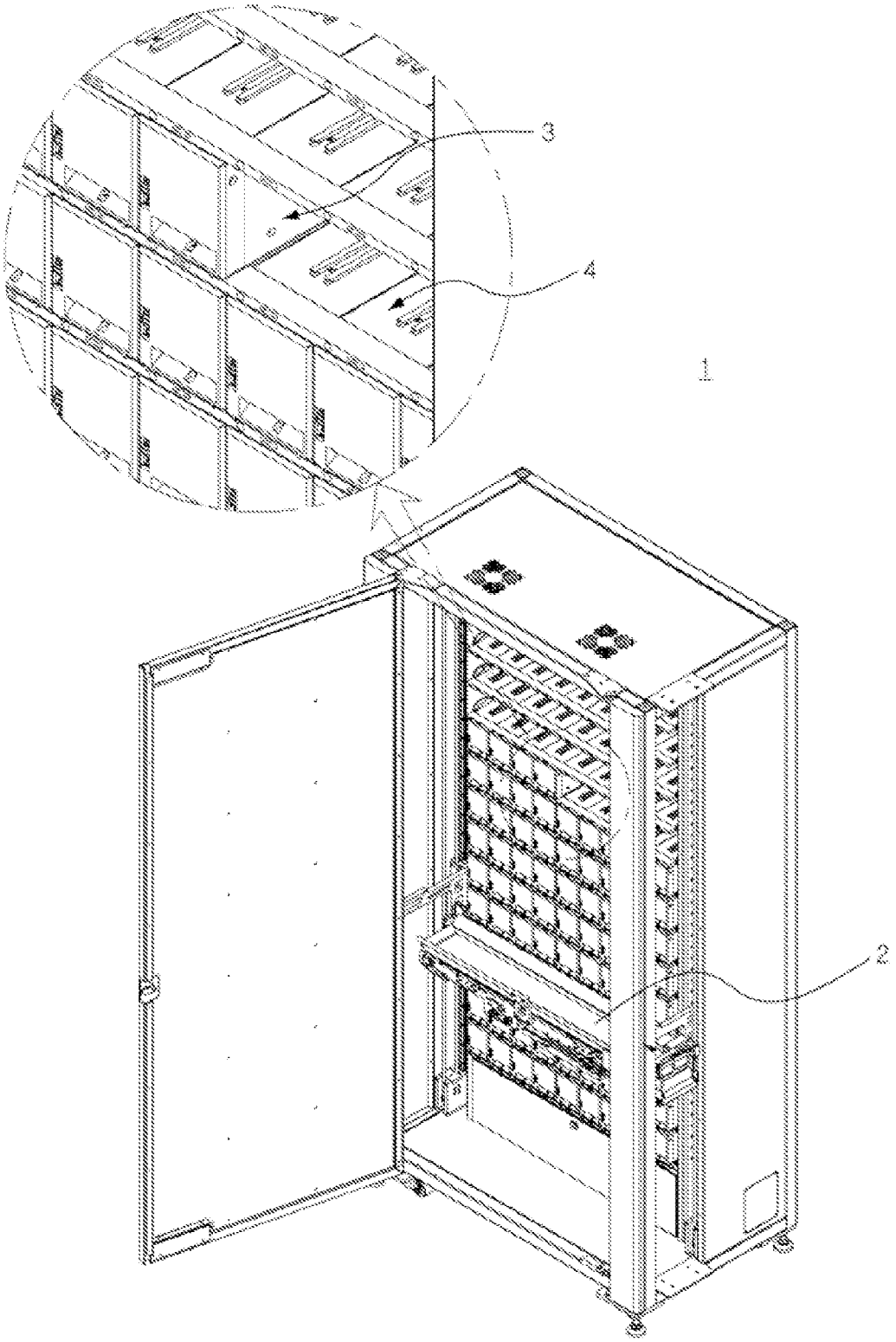
FIG. 1 is a perspective view of a drug dispensing apparatus according to an embodiment of the present invention.

Hereinafter, embodiments of the present invention will be described with reference to the accompanying drawings. If there is no specific definition or reference, the term representing a direction used in this description is on the basis of a state illustrated in the drawings. Also, the same reference numeral denotes the same member throughout embodiments. In the drawings, a thickness or size may be exaggerated for convenience of descriptions, but it does not mean that the thickness or size of each element does not entirely reflect an actual size.

A drug dispensing apparatus including components according to the present invention will be described with reference to FIG. 1. FIG. 1 is a perspective view of a drug dispensing apparatus according to an embodiment of the present invention.

A drug dispensing apparatus 1 according to an embodiment includes a cartridge 4, a drug dispensing box 3, and a device 2 for gathering dispensed drugs (hereinafter, referred to as a drug gathering device). The present invention relates to the dispensing apparatus, especially the cartridge 4 and the drug dispensing box 3 among these components. Hereinafter, the components will be described in detail with reference to the accompanying drawings.

Figure 2:
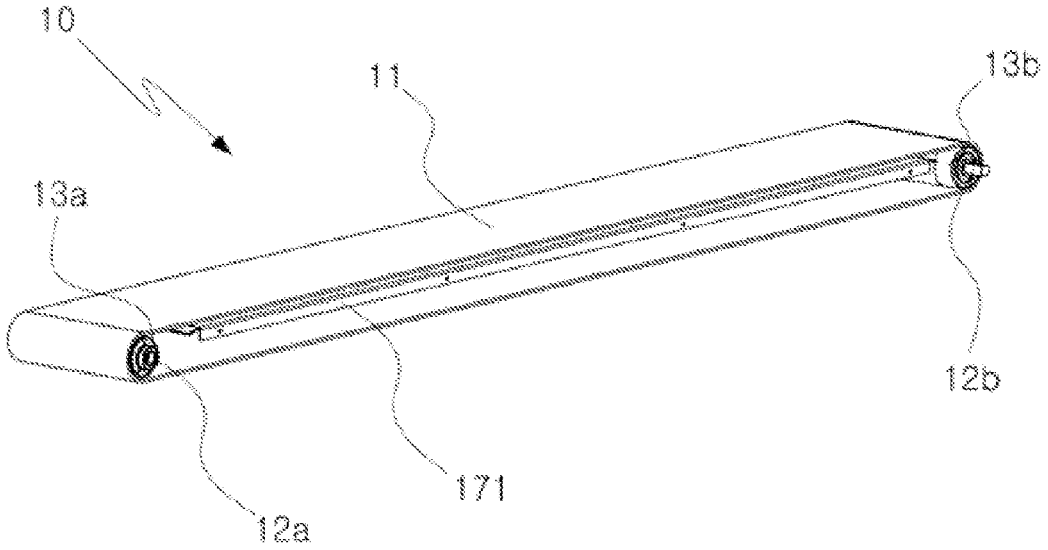
FIG. 2 is a partial cutoff perspective view of a conveyer according to an embodiment.
Figure 3:
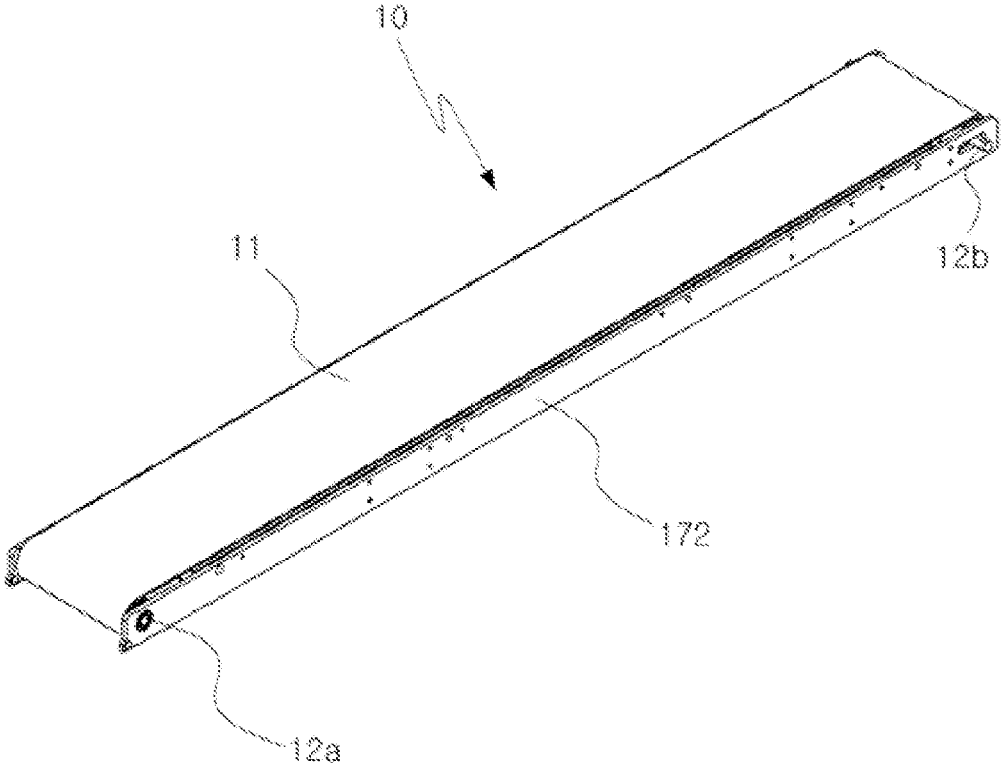
FIG. 3 is a perspective view of the conveyer according to an embodiment.

The conveyor according to an embodiment will be described with reference to FIGS. 2 and 3. FIG. 2 is a partial cutoff perspective view of a conveyer according to an embodiment, and FIG. 3 is a perspective view of the conveyer according to an embodiment.

The conveyer 10 is a component on which dispensed drugs are seated. The conveyer 10 includes a conveyer belt 11, a pair of orbital shafts 120*a* and 12*b*, a pair of path converting rolls 13*a* and 135*b*, and a driving roll 14.

The conveyer belt 11 rotates along an unlimited orbit. The dispensed drugs are seated on the conveyer belt 11. Also, the pair of orbital shafts 12*a* and 12*b* is in charge of both shafts of the unlimited orbit around which the conveyer belt 11 rotates. That is, the conveyer belt 11 rotates an orbit passing through outer circumferential surfaces of the pair of orbital shafts 12*a* and 12*b*.

As shown in FIG. 2, the conveyer belt 11 may rotate via the pair of path converting rolls 13*a* and 13*b*. A support plate 171 is disposed on a lower end of an upper surface of the conveyer belt 11. The support plate 171 supports the upper surface of the conveyer belt 11 and receives impacts, which are applied to dropping drugs when the drugs are dispensed, through the upper surface of the conveyer belt 11. As shown in FIG. 3, the drug gathering device according to the current embodiment includes a side member 172. The above-described support plate 171 is fixed to the side member 172.

Figure 4A:
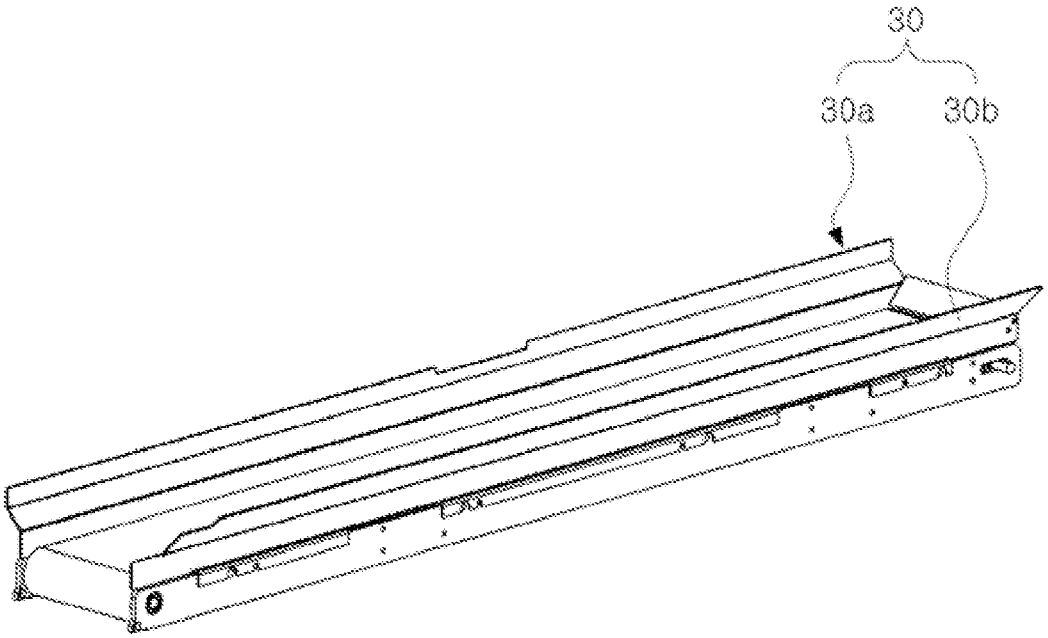
FIG. 4A is a perspective view of a drug gathering device including a side guide unit according to an embodiment.

A side guide unit according to an embodiment will be described with reference to FIGS. 4A and 4B. FIG. 4A is a perspective view of the drug gathering device including the side guide unit according to an embodiment, and FIG. 4*b* is a side view of the drug gathering device of FIG. 4A.

As shown in FIG. 4A, at least one side guide unit 40 disposed at a predetermined height to prevent drugs from being separated to the outside when the drugs are seated may be disposed on a side surface of the drug gathering device.

Figure 4B:
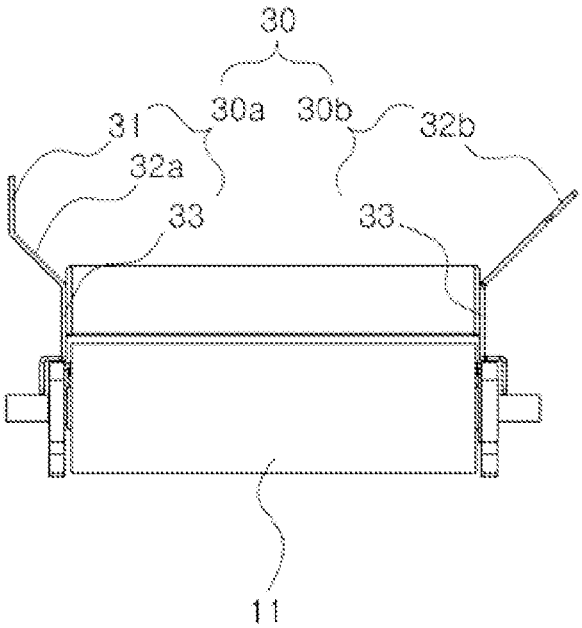
FIG. 4B is a side view of the drug gathering device of FIG. 4A.

In detail, as shown in FIG. 4B, the side guide unit 30 may include a fixing part 33, first inclination parts 32*a* and 32*b*, and a height reinforcement part 31. The fixing part 33 may be a component for fixing the side guide units 30*a* and 30*b* to the side member. Each of the first inclination parts 32*a* and 32*b* is inclined downward toward the outside. The first inclination parts 32*a* and 32*b* may expand an area on which the dispensed drugs are seated and minimize dropping impacts of the drugs due to the inclination when the drugs drop. The height reinforcement part 31 may secure a height of the side guide unit 30 to prevent the drugs from bounding up and being separated outward due to the bounce of the drugs while the drugs are dispensed.

Figure 5A:
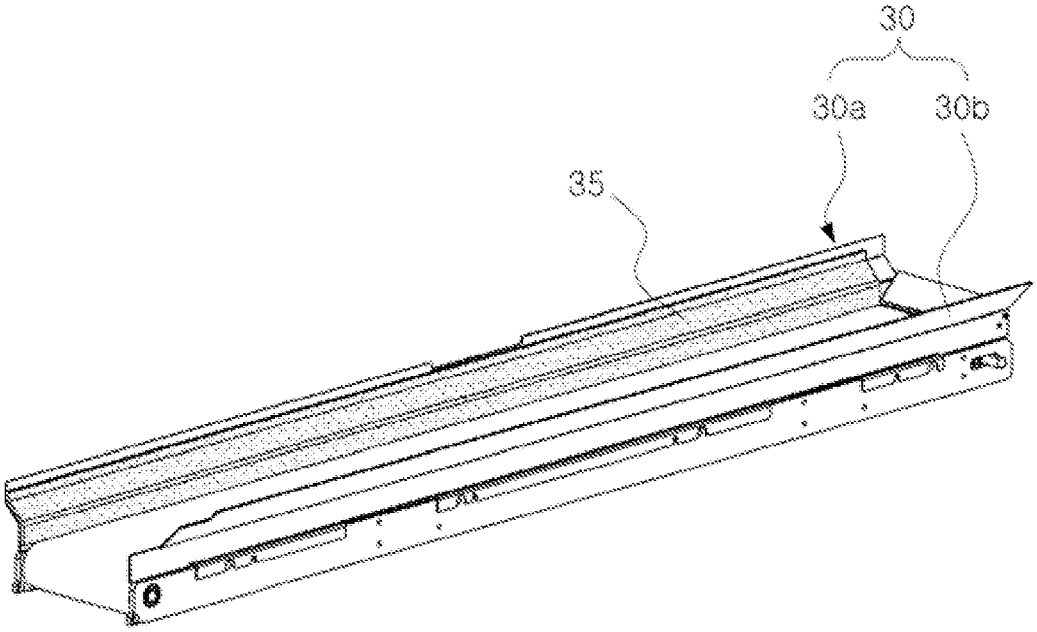
FIG. 5A is a perspective view of a drug gathering device including a side guide unit according to another embodiment.

A side guide unit according to another embodiment will be described with reference to FIGS. 5A and 5B. FIG. 5A is a perspective view of a drug gathering device including a side guide unit according to another embodiment, and FIG. 5B is a side view of the drug gathering device of FIG. 5A.

Figure 5B:
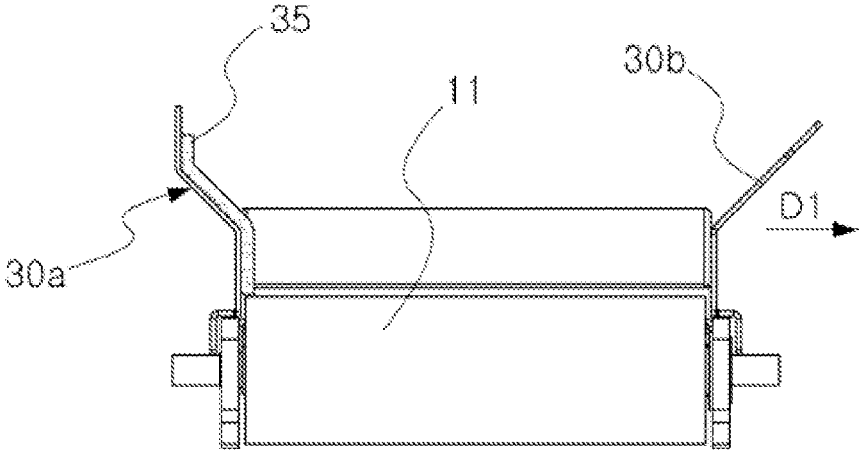
FIG. 5B is a side view of the drug gathering device of FIG. 5A.

As shown in FIGS. 5A and 5B, a side guide unit 30 may include a buffer member 35 for absorbing an impact generated when dispensed drugs collide therewith on an inner surface thereof. As shown in FIG. 5B, the buffer member 35 may be formed of a material that can absorb impacts on each of inner surfaces of the side guide units 30*a* and 30*b*. In detail, the buffer member 35 may be disposed on a side guide unit 30*a* that is disposed opposite to a direction D1 in which at least drug dispensing box is disposed.

Figure 6A:
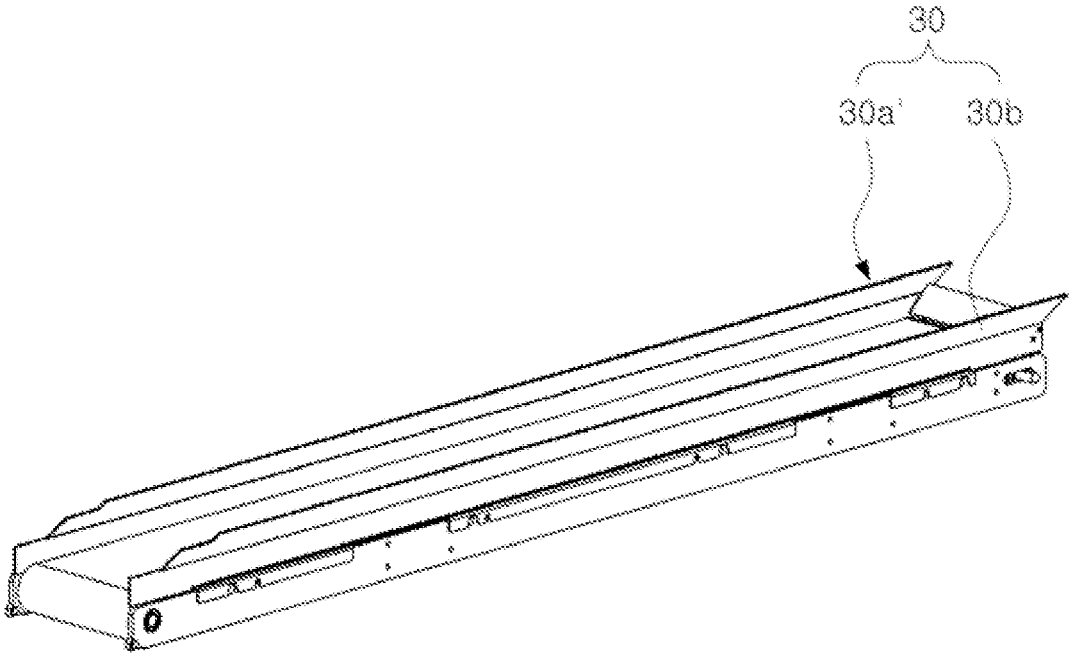
FIG. 6A is a perspective view of a drug gathering device including a side guide unit according to further another embodiment.

A side guide unit according to further another embodiment will be described with reference to FIGS. 6A and 6B. FIG. 6A is a perspective view of a drug gathering device including a side guide unit according to further another embodiment, and FIG. 6B is a side view of the drug gathering device of FIG. 6A.

Figure 6B:
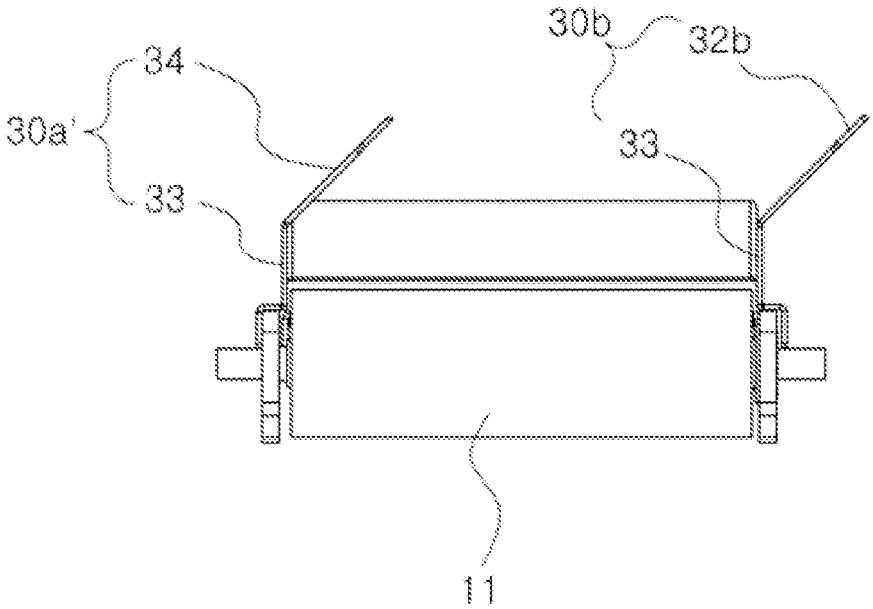
FIG. 6B is a side view of the drug gathering device of FIG. 6A.

As shown in FIGS. 6A and 6B, a side guide unit 30*a*' disposed opposite to a direction in which the drug dispensing box is disposed may include a second inclination part 34 having a shape inclined opposite to that of each of the first inclination parts 32*a* and 32*b*. The second inclination part 34 may be inclined inward to actively prevent drugs dropping when dispensed from bounding outward and thus being separated.

Figure 7:
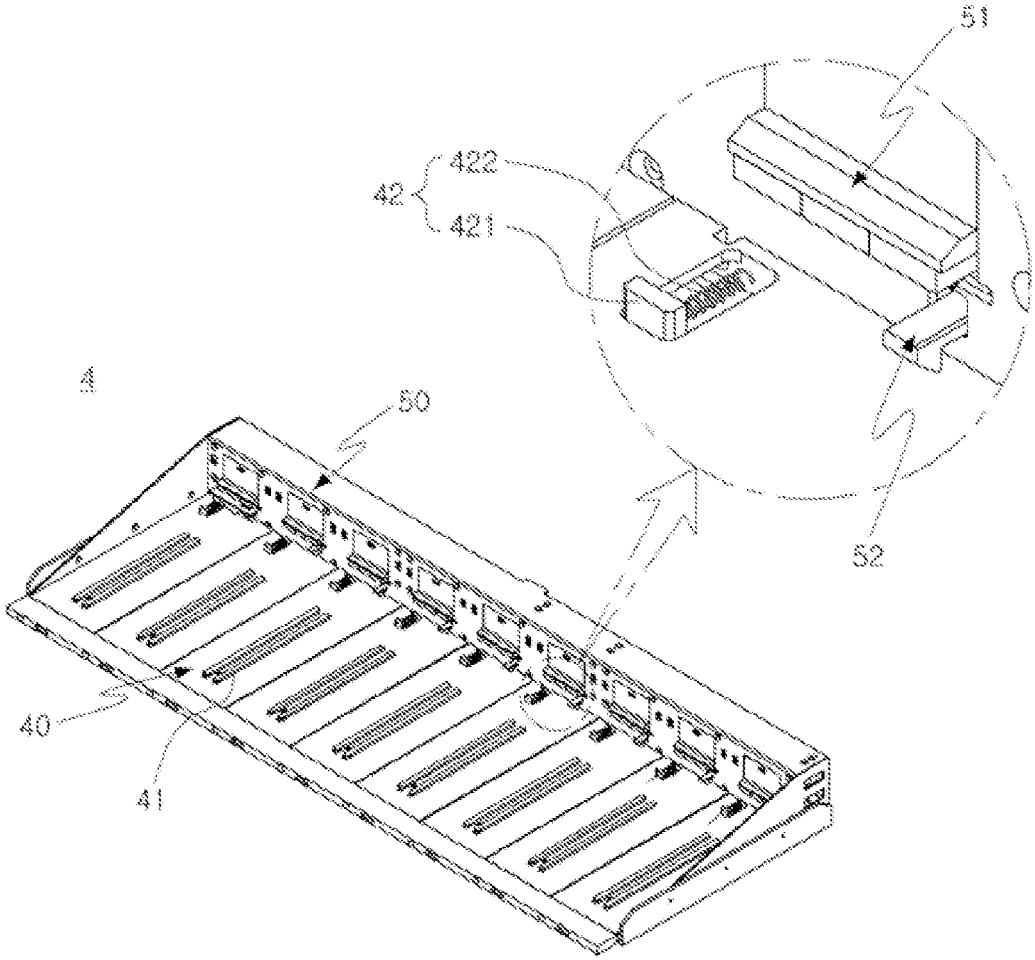
FIG. 7 is a perspective view of a cartridge according to an embodiment.
Figure 8:
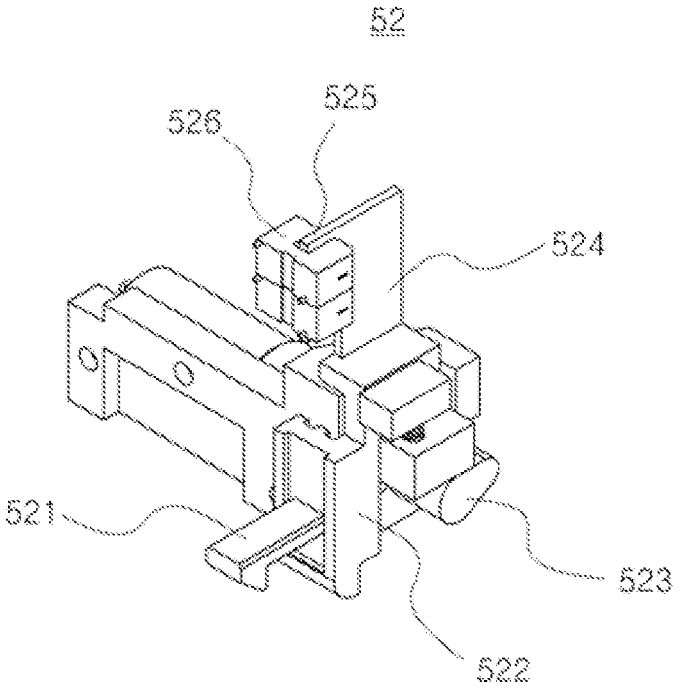
FIGS. 8 and 9 are perspective views illustrating a configuration and operation of a fixing part according to an embodiment.
Figure 9:
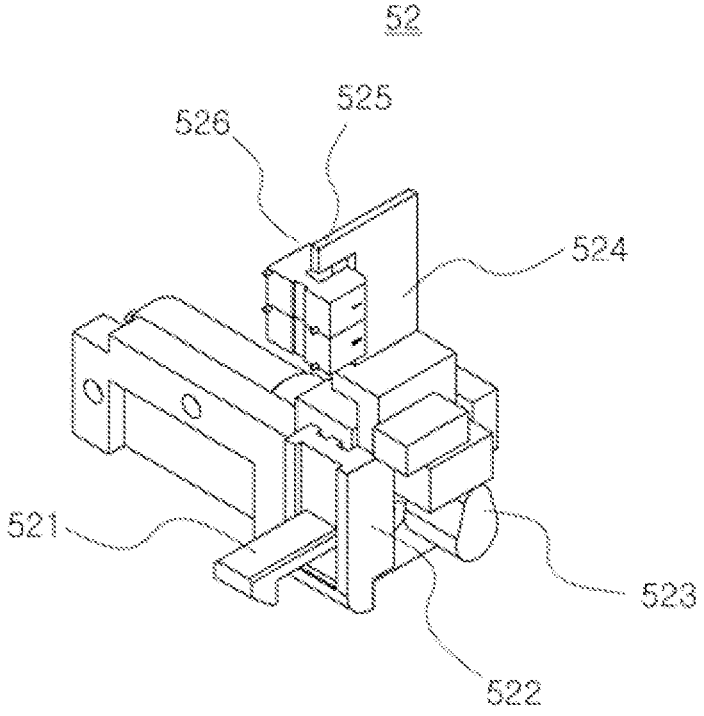

A cartridge according to an embodiment will be described with reference to FIGS. 7 to 9. FIG. 7 is a perspective view of a cartridge according to an embodiment, and FIGS. 8 and 9 are perspective views illustrating a configuration and operation of a fixing part according to an embodiment.

A cartridge 4 includes a cartridge housing constituted by a lower housing 40 and a rear housing 50. The lower housing 40 supports a drug dispensing box when the drug dispensing box enters therein, and the rear housing 50 restricts the entry of the drug dispensing box by a predetermined distance. A rail 41 is disposed on an upper surface of the lower housing 40 along an entry path of the drug dispensing box. The rail 41 may guide the entry of the drug dispensing box along the entry path so as to couple the drug dispensing box to the cartridge. The rail 41 may have a predetermined length and protrude upward. Also, the rail 41 may be provided in at least two which protrude parallel to each other.

A first data transmitting/receiving terminal 51 may be disposed on the rear housing 50. The first data transmitting/receiving terminal 51 may be connected to the drug dispensing box to transmit/receive data into/from a control unit disposed within the drug dispensing box. For example, the drug dispensing apparatus receives a universally unique identification (UUID) signal of the drug dispensing box through the first data transmitting/receiving terminal 51 to acquire information such as kinds and numbers of drugs stored in the corresponding drug dispensing box.

In the current embodiment, the first data transmitting/receiving terminal 51 may have a protruding shape with a predetermined stepped portion forward from the rear housing 50. Also, a plurality of connecting pins for electrically being connected to the drug dispensing box are disposed on a lower end of the first data transmitting/receiving terminal 51.

A separation promotion part 42 is disposed on the lower housing 40. The separation promotion part 42 may apply force to the drug dispensing box in a separation direction when the drug dispensing box is separated.

In detail, the separation promotion part 42 includes a first protrusion 421 and a first elastic member 422. The first protrusion 421 protrudes from an upper end of the lower housing 40 and exposed to the outside. The first elastic member 422 provides restoring force due to elastic force to the drug dispensing box when the drug dispensing box is separated after being pressed while being connected.

Also, a locking unit 52 for fixing the drug dispensing box or separably releasing the drug dispensing box is disposed on the rear housing 50. As shown in FIG. 8, the locking unit 52 includes a cam 523, a locking unit body 522, a hook part 521, an extension part 524, a detection target part 525, and a detection part 526.

The cam 523 rotates about a predetermined axis and has a long radius portion and a short radius portion with respect to the rotation center axis. The locking unit body 522 constitutes a main body of the locking unit 52. As shown in FIGS. 8 and 9, the locking unit body 522 is disposed to contact an outer circumference surface of the cam 523. Thus, when the locking unit body 522 contacts the long radius portion as the cam 523 rotates, the locking unit body 522 ascends. Also, when the locking unit body 522 contacts the short radius portion, the locking unit body 522 descends. The hook part 521 extends from a front surface of the locking unit body 522 to ascend or descend together with the locking unit body 522 when the locking unit body 522 ascends or descends. The extension part 524 extends upward from an upper end of the locking unit body 522. Also, the detection part 526 is disposed adjacent to the extension part 524. A sensor including a light receiving part and a light emitting part, for example, an infrared sensor may be used as the detection part 526. The detection target part 525 extends from a side of the extension part 524. The detection target part 525 is disposed between the light receiving part and the light emitting part of the detection part to ascend or descend, thereby determining whether the locking unit 52 is disposed at the fixed or released position.

Figure 10:
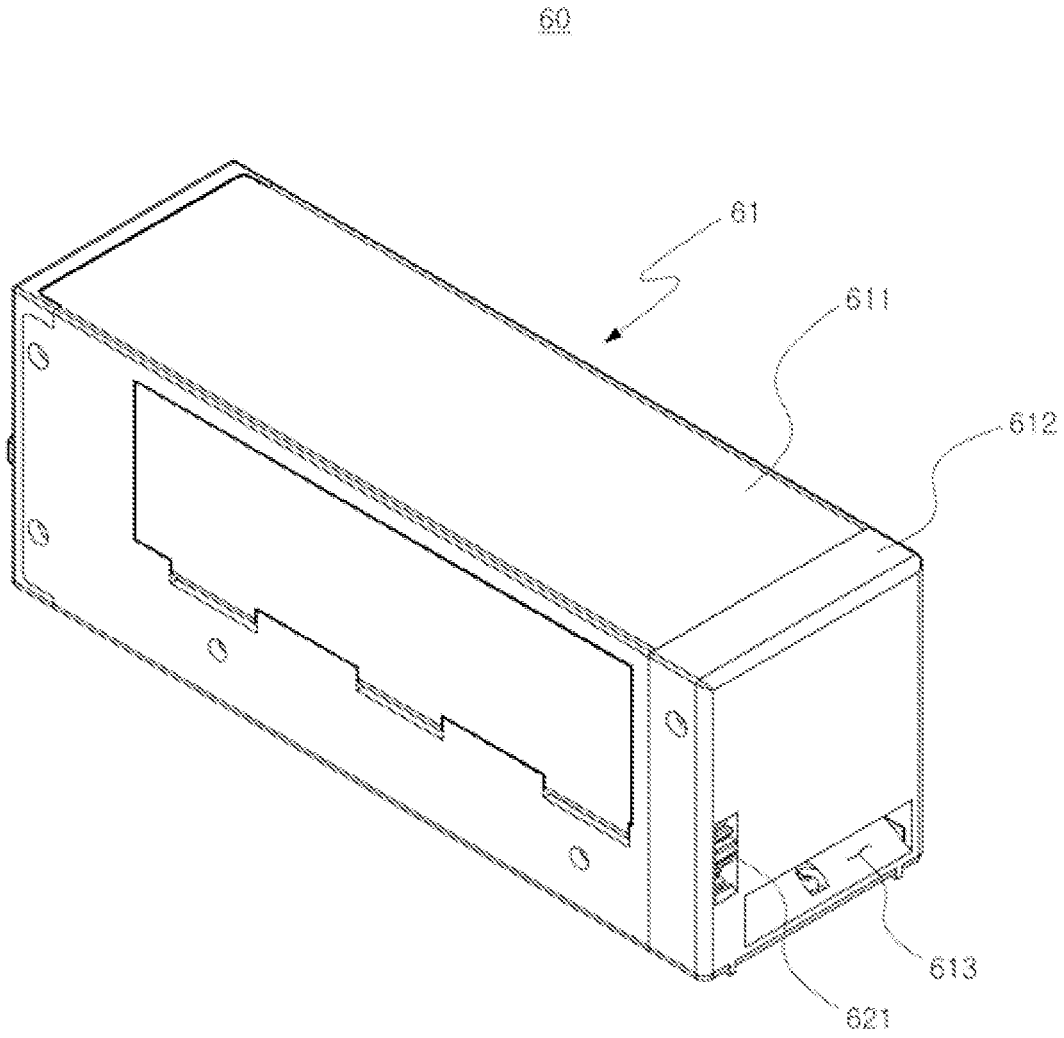
FIG. 10 is a perspective view of a drug dispensing box according to an embodiment.

A drug dispensing box according to an embodiment will be described with reference to FIGS. 10 to 12. FIG. 10 is a perspective view of a drug dispensing box according to an embodiment, FIG. 11 is a bottom perspective view illustrating a front side of the drug dispensing box of FIG. 10, and FIG. 12 is a bottom perspective view illustrating a rear side of the drug dispensing box of FIG. 10.

A drug dispensing box 60 includes a dispensing box housing 61. In detail, the housing 61 includes a housing body 611 and a front part 612. A discharge hole 613 is defined in the front part 612, and a gear 621 is disposed on the front part 612 in a state where the gear 621 is exposed to the outside.

Figure 11:
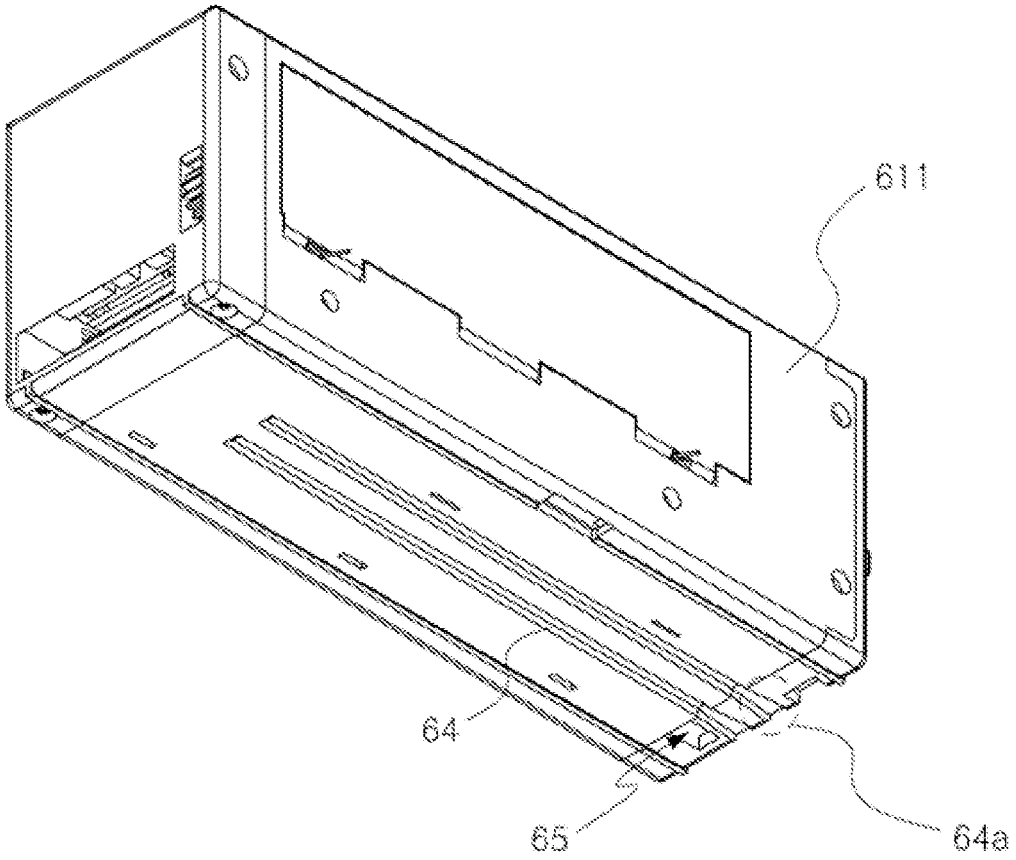
FIG. 11 is a bottom perspective view illustrating a front side of the drug dispensing box of FIG. 10.
Figure 12:
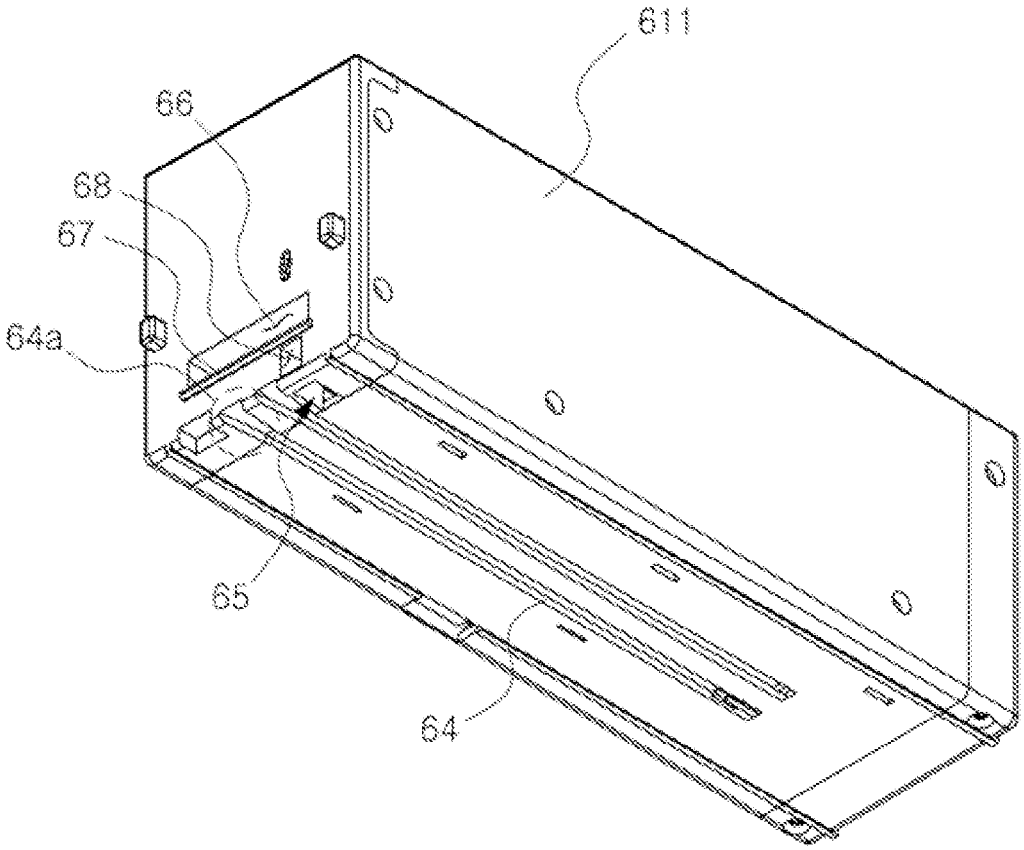
FIG. 12 is a bottom perspective view illustrating a rear side of the drug dispensing box of FIG. 10.

As shown in FIG. 11, a rail accommodation unit 64 is defined in a bottom surface of the housing body 611. The above-described rail may be inserted into the rail accommodation unit 64 and then guided along the entry path. The rail accommodation unit 64 may be defined up to a rear surface of the housing body 611. Also, the rail is accommodated into the rail accommodation unit 64 from a rear side of the rail accommodation unit 64 when the drug dispensing box and the cartridge are connected to each other. Here, the rail may be gradually accommodated forward along the rail accommodation unit 64. Here, in the rail accommodation unit 64, an accommodation starting part 64*a* may be disposed adjacent to the rear surface of the dispensing box housing 611. The accommodation starting part 64*a* may be provided as a portion of the rail accommodation unit 64 and have a width gradually increasing toward the rear surface. The accommodation starting part 64*a* may provide a starting point for accommodating the rail and also have the expanded width so that the rail is more easily accommodated into the rail accommodation unit 64*a*. The accommodation starting part 64*a* may have various lengths. That is, the whole rail accommodation unit 64 may have a width gradually increasing toward the rear surface.

A separation promotion accommodation groove 65 for accommodating the above-described separation promotion part is defined in the bottom surface of the housing body 611. As described above, the separation promotion part may be pressed in the state where the separation promotion part is accommodated into the accommodation groove 65 when the drug dispensing box and the cartridge are connected to each other or may apply force due to the elastic force to the housing body 611 in the separation direction.

Data terminal units 66 and 67 may be disposed on the rear surface of the housing body 611. In detail, each of the data terminal units 66 and 67 includes a terminal accommodation groove 66 and a second data transmitting/receiving terminal 67. The terminal accommodation groove 66 accommodates the data transmitting/receiving terminal of the cartridge, and the second data transmitting/receiving terminal 67 is electrically connected to the data transmitting/receiving terminal of the cartridge.

Also, a hanger part 68 is disposed on the rear surface of the housing body 611. The hanger part 68 may have a stepped groove shape so that the hook part of the locking unit of the cartridge is hung.

Figure 13:
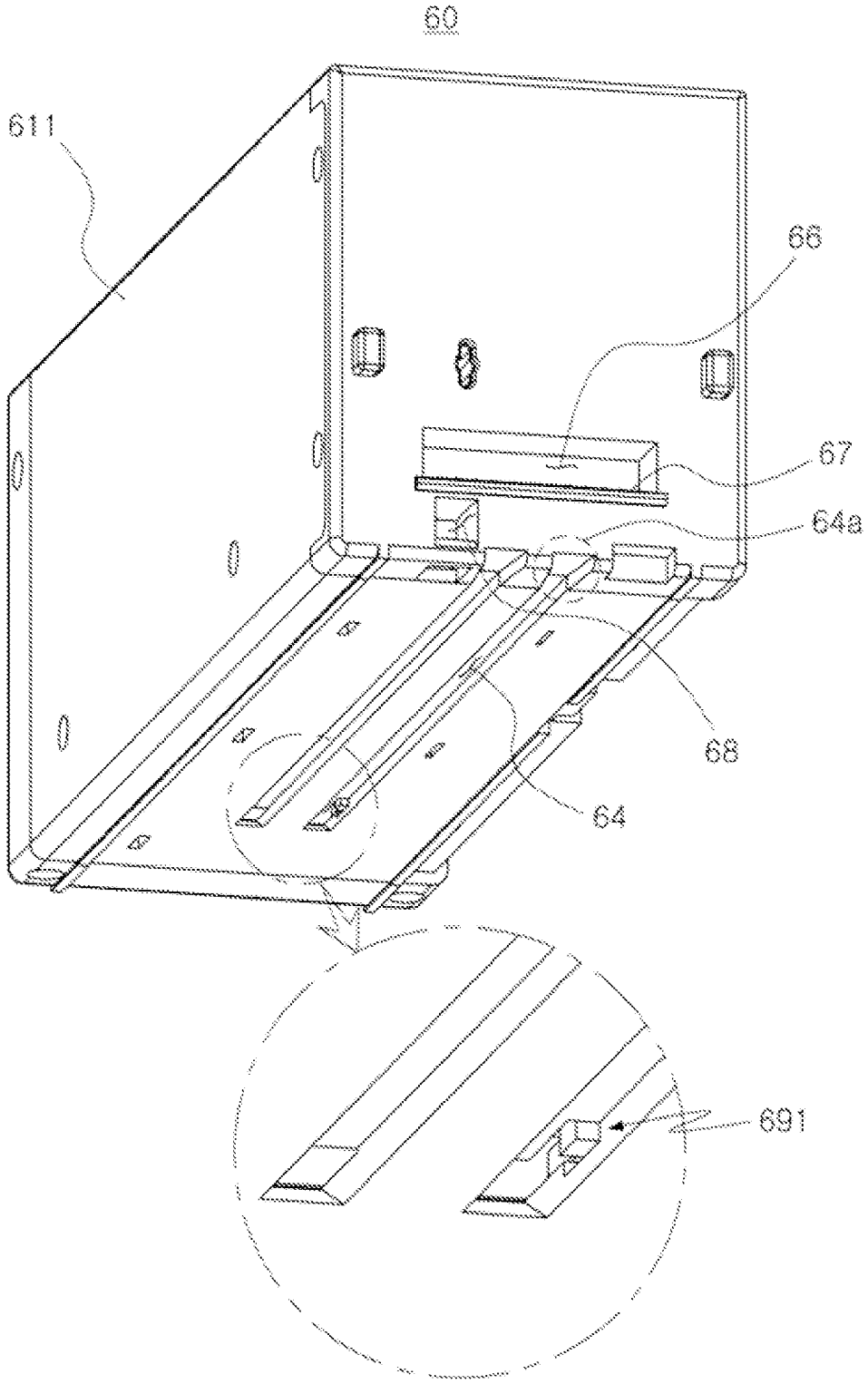
FIG. 13 is a bottom perspective view illustrating the rear side of the drug dispensing box of FIG. 10 when viewed at a different angle.
Figure 14:
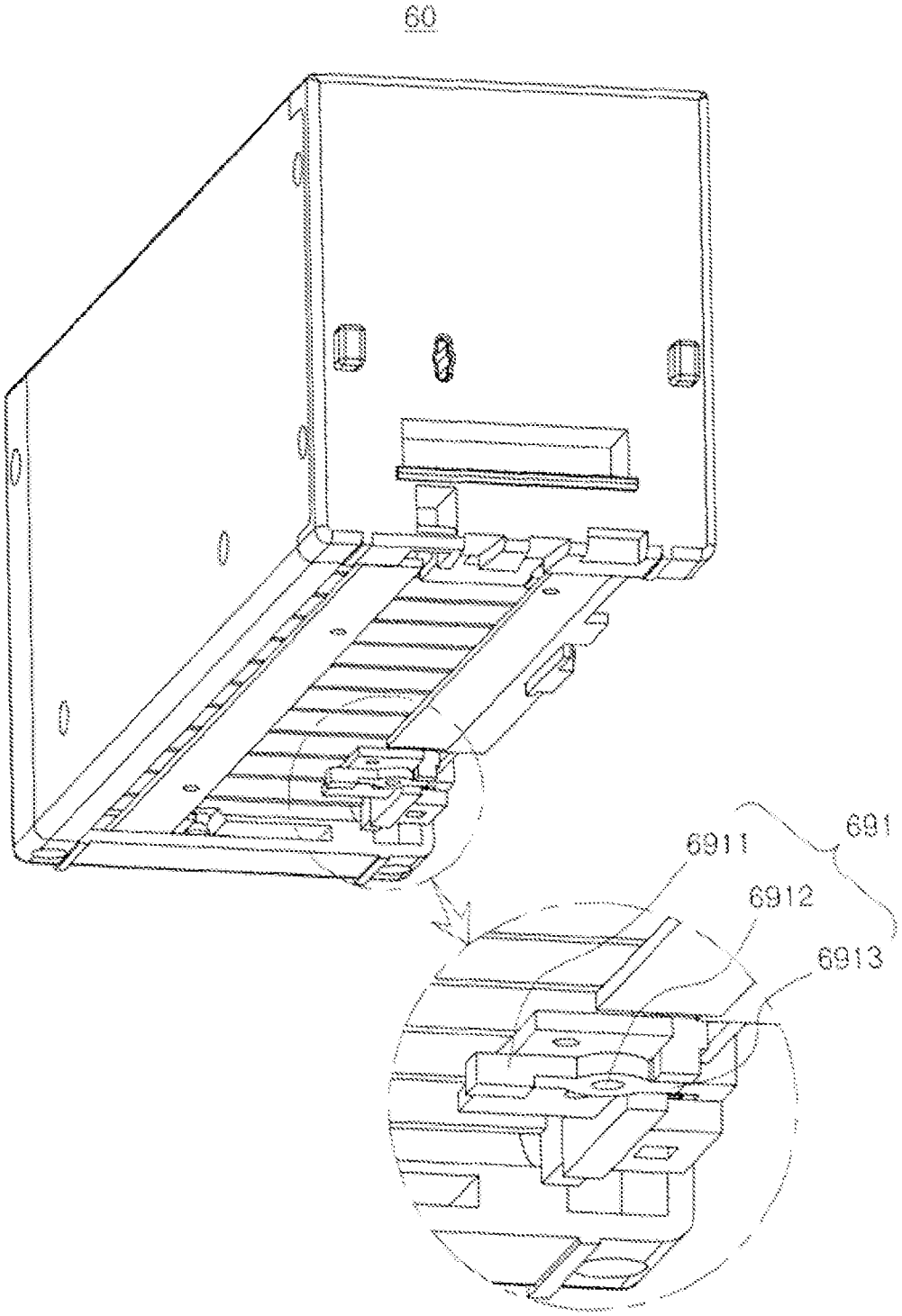
FIGS. 14 to 16 are cutoff perspective views of the drug dispensing box of FIG. 10.

A power transmission unit of the drug dispensing box according to an embodiment will be described with reference to FIGS. 13 to 16. FIG. 13 is a bottom perspective view illustrating the rear side of the drug dispensing box of FIG. 10 when viewed at a different angle, and FIGS. 14 to 16 are cutoff perspective views of the drug dispensing box of FIG. 10.

A rotation part 681 is exposed from the front side of the rail accommodation unit 64 defined in the bottom surface of the housing body 611. As shown in FIGS. 13 and 14, the rotation part 691 may be one component of a power blocking unit. That is, the rotation part 691 may be a component that is pressed by the rail when the above-described rail is accommodated. As described above, the drug dispensing box may include at least one gear for receiving power from the outside. The power blocking unit may be a mechanical component for controlling gears to restrict or release the gears so that the gears do not rotate in spite of the power transmitted from the outside.

Figure 15:
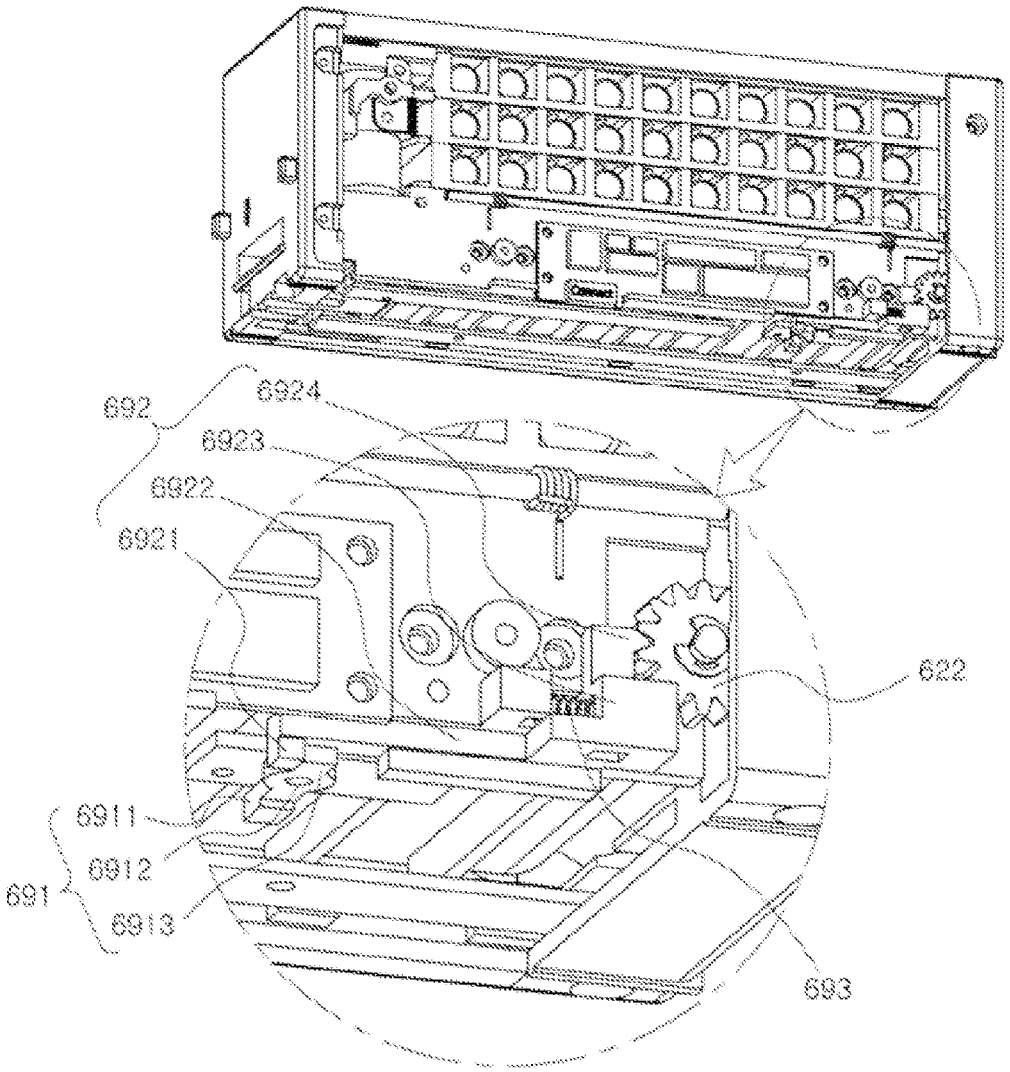
Figure 16:
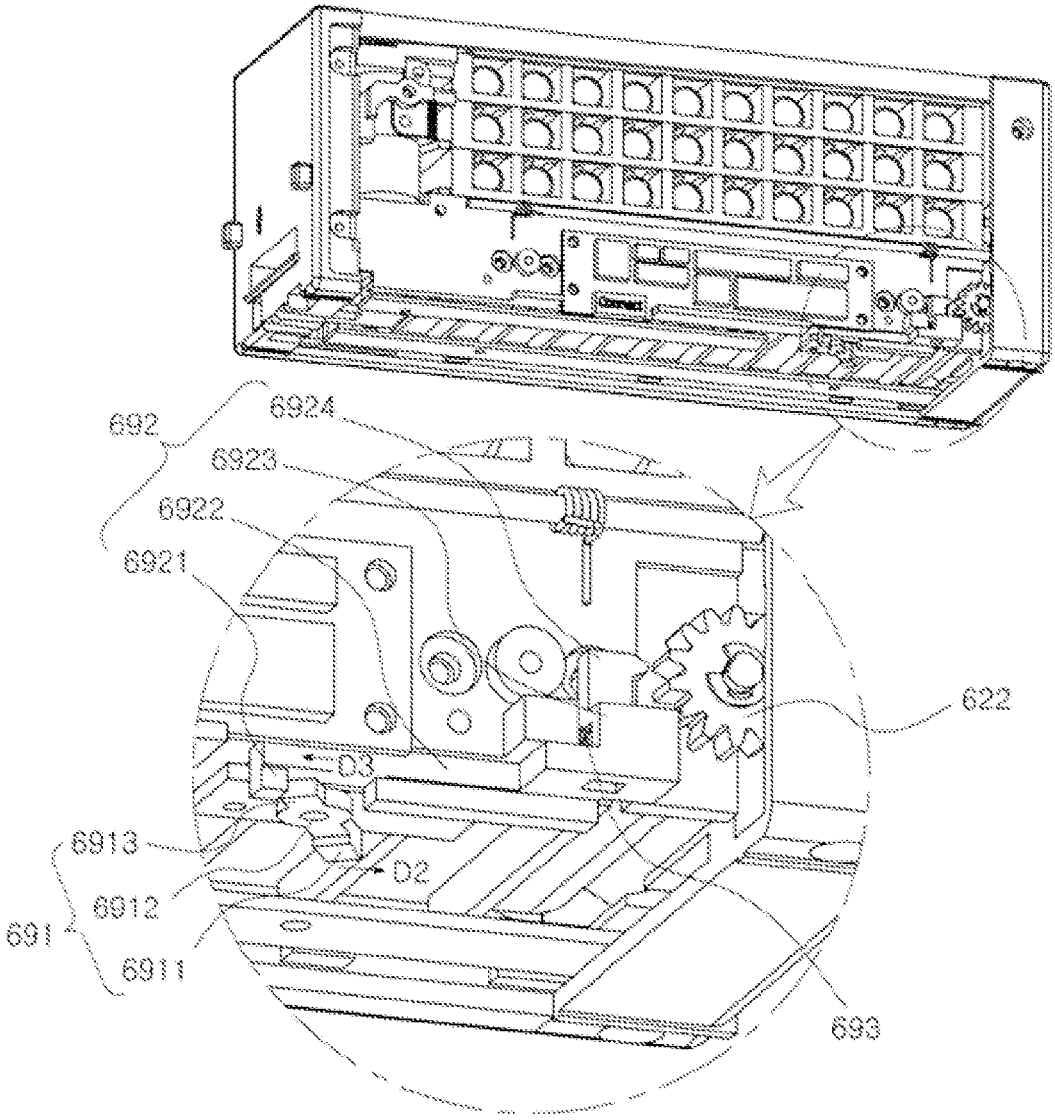

In detail, referring to FIG. 15, the power blocking unit includes the rotation part 691 and the blocking unit body 692. The rotation part 691 includes a first end 6911, a rotation shaft 6912, and a second end 6913. The first end 6911 rotates about the rotation shaft 6912. The second end 6913 is disposed on the other side of the first end 6911 with respect to the rotation shaft 6912 to rotate in the same direction as the rotation direction of the first end 6911.

The blocking unit body 692 includes a contact part 6921, a first extension part 6922, a second extension part 6923, and a second protrusion 6924. The contact part 6921 is in contact with the second end 6913. The first extension part 6922 extends from the contact part 6921 toward the gear 622, and the second extension part 6923 extends upward from a gear-side end of the first extension part 6922. The second protrusion 6924 protruding toward the gear 622 is disposed on an end of the second extension part 6923. The second protrusion 6924 may be inserted between teeth of the gear 622 to restrict the rotation of the gear 622 or be separated from the space between the teeth of the gear 622 so that the gear is released to rotate. A second elastic member 693 may be disposed to contact the second extension part 6923. The second elastic member 693 may push the second extension part 6923 in a direction of the gear 622 by using elasticity.

Referring to FIG. 16, when the first end 6911 is pushed by the above-described rail to rotate in a gear-side direction D2, the second end 6913 rotates in an opposite direction D3 of the gear 622. Here, the contact part 6921 may be pushed retreated by the second end 6913 in the opposite direction D3 of the gear 622, and the second protrusion 6924 connected to the contact part 6921 through first and second connection parts 6922 and 6923 may also be retreated in the opposite direction D3 of the gear 622 and then separated from the space between the teeth of the gear 622. In this state, the gear 622 rotatably released.

Figure 17:
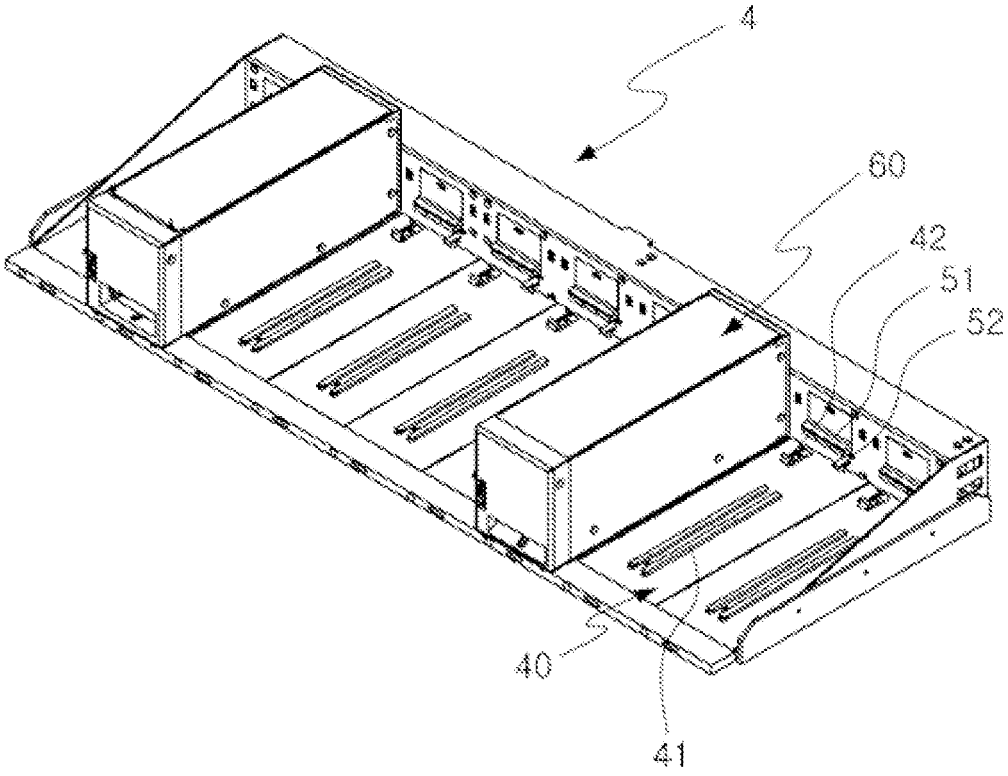
FIG. 17 is a perspective view illustrating a connected configuration between the drug dispensing box and the cartridge according to an embodiment.
Figure 18:
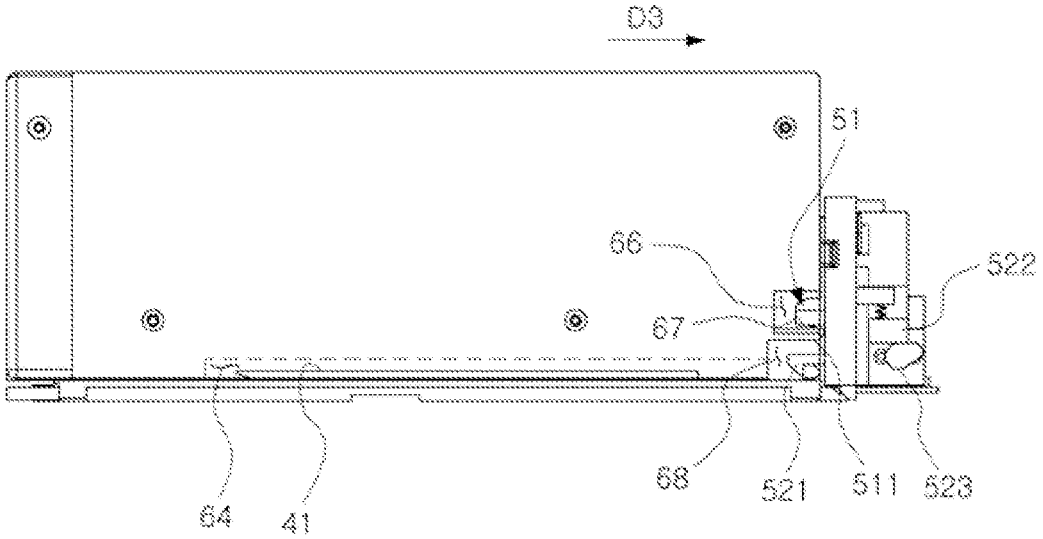
FIGS. 18 and 19 are schematic views illustrating the connected configuration between the drug dispensing box and the cartridge according to an embodiment.
Figure 19:
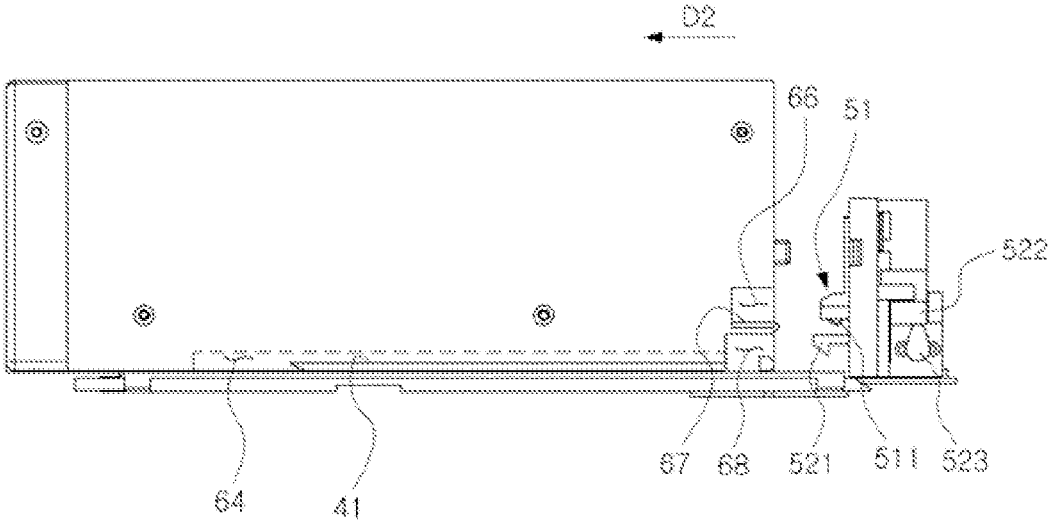

A connected configuration between the drug dispensing box and the cartridge according to an embodiment will be described with reference to FIGS. 17 to 19. FIG. 17 is a perspective view illustrating a connected configuration between the drug dispensing box and the cartridge according to an embodiment, and FIGS. 18 and 19 are schematic views illustrating the connected configuration between the drug dispensing box and the cartridge according to an embodiment.

As shown in FIG. 17, the drug dispensing box 60 is inserted along the rail 41 disposed on the lower housing 40 of the cartridge 4 and then is coupled to the cartridge 4. Here, as described above, the separation promotion part 42, the first transmitting/receiving terminal 51, and the locking unit 52 which are disposed on the cartridge 4 may be inserted into components corresponding thereof, respectively.

In detail, when the drug dispensing box 60 is coupled, the rail 41 is accommodated into the rail accommodation unit 64, and the hook part 521 is inserted into the hanger part 69 disposed on the rear surface of the drug dispensing box 60. Thus, the drug dispensing box 60 may be coupled to the cartridge 4. Also, the first data transmitting/receiving terminal 51 is electrically connected to the drug dispensing box 60 in a state where the first data transmitting/receiving terminal 51 is accommodated into the data terminal unit 66. Here, the short radius portion of the outer circumference surface of the cam 523 contacts the locking unit body 522.

On the other hand, when the drug dispensing box 60 is separated, the long radius portion of the outer circumference surface of the cam 523 contacts the locking unit body 522 to lift the hook part 521. When the hook part 521 is lifted, the hook part 521 may be released from the hanger part 68 disposed on the rear surface of the drug dispensing box 60. Thus, the hook part 521 may become in a separable state. When the drug dispensing box 60 is separated, a portion of the rail 41 to be separated from the rail accommodation groove 64 may gradually increase. Also, the first data transmitting/receiving terminal 51 may be separated from the data terminal unit 66.

According to the present invention, the rail for guiding the drug dispensing box when the drug dispensing box and the cartridge are connected to the other may be provided to connect the drug dispensing box to the cartridge at a regular position.

Also, according to the present invention, since the power transmission blocking unit for transmitting or blocking the external power to the drug dispensing box to dispense drugs is provided, the drugs may be dispensed at an adequate time.

Also, according to the present invention, the fixing part may be provided to firmly maintain the coupled structure between the drug dispensing box and the cartridge even while the drugs are dispensed.

Although exemplary embodiments of the present invention are described, the technical spirit of the present invention is not limited to the above-described exemplary embodiments, and thus a drug dispensing box and cartridge having various mutually coupled structures can be realized without departing form the spirit or scope of the invention.

What is claimed is:

1. A cartridge disposed on each of floors of a drug dispensing apparatus and connected to each of a plurality of drug dispensing boxes, the cartridge comprising:

a cartridge housing comprising a lower housing supporting the drug dispensing box and a rear housing restricting entry of the drug dispensing box by a predetermined distance;

a rail disposed along an entry path of the drug dispensing box on the lower housing;

a first data transmitting/receiving terminal connected to the drug dispensing box to transmit/receive data; and a separation promotion part applying force to the drug dispensing box in a separation direction when the drug dispensing box is separated, wherein the separation promotion part comprises:

a first protrusion protruding from an upper end of the lower housing and exposed to the outside, and a first elastic member connected to the first protrusion, the first elastic member being pressed when the drug dispensing box is connected and providing restoring force to the drug dispensing box in the separation direction when the drug dispensing box is separated.

2. The cartridge of claim 1, wherein the rail protrudes upward with a predetermined length.

3. The cartridge of claim 2, wherein the rail is provided in at least two, and the at least two rails are disposed parallel to each other.

4. The cartridge of claim 1, wherein the first data transmitting/receiving terminal has a protruding shape with a predetermined stepped portion forward from the rear housing.

5. The cartridge of claim 4, wherein the first data transmitting/receiving terminal comprises a plurality of connecting pins on a lower end thereof.

6. The cartridge of claim 1, further comprising a locking unit disposed on the cartridge housing to fix the drug dispensing box or release the drug dispensing box so that the drug dispensing box is separable.

7. The cartridge of claim 6, wherein the locking unit comprises:

a cam rotating about a predetermined rotation axis, the cam having a long radius portion and short radius portion in a radial direction with respect to the rotation axis;

a locking unit body contacting an outer circumference surface of the cam, the locking unit body ascending when the locking unit body contacts the long radius portion of the cam and descending when the locking unit body contacts the short radius portion of the cam; and a hook part extending from a front surface of the locking unit body, the hook part ascending or descending together with the locking unit body.

8. A drug dispensing box connected to a cartridge, the drug dispensing box comprising:

a dispensing box housing;

a rail accommodation unit defined in a bottom surface of the dispensing box housing to guide dispensing box housing along an entry path of the cartridge when a rail of the cartridge is accommodated for the dispensing box housing to be connected to the cartridge;

a data terminal unit electrically connected to the cartridge to transmit/receive data into/from the cartridge, at least one gear receiving external power; and a power transmission blocking unit restricting rotation of the gear or releasing the gear, wherein the power transmission blocking unit comprises:

a rotation part comprising a first end alternately rotating in a direction of the gear and in a direction opposite to that of the gear with respect to a rotation shaft and a second end disposed on the other side of the first end to rotate in a direction opposite to the rotation direction of the first end, and a blocking unit body connected to the second end, the blocking unit body comprising a second protrusion inserted between teeth of the gear, wherein the blocking unit body is retreated together with the second end when the second end rotates in a direction opposite to that of the gear to allow the second protrusion to be separated from a space between the teeth of the gear.

9. The drug dispensing box of claim 8, wherein the rail accommodation unit is disposed to reach a rear surface of the dispensing box housing, thereby being exposed from the rear surface of the dispensing box housing.

10. The drug dispensing box of claim 9, wherein the rail accommodation unit further comprises an accommodation starting part having a width gradually increasing toward the rear surface of the dispensing body housing.

11. The drug dispensing box of claim 8, wherein the data terminal unit comprises:

a terminal accommodation grove accommodating a data transmitting/receiving terminal of the cartridge; and a second data transmitting/receiving terminal disposed on a lower end of the terminal accommodation groove, the second data transmitting/receiving terminal being connected to the data transmitting/receiving terminal of the cartridge.

12. The drug dispensing box of claim 8, further comprising a hanger part having a stepped groove shape so that a hook part of the cartridge is accommodated and hung.

13. The drug dispensing box of claim 8, wherein the dispensing box housing has a separation promotion accommodation groove in which a separation promotion part of the cartridge is accommodated.

14. The drug dispensing box of claim 8, further comprising a second elastic member connected to the blocking unit body to provide elastic force to the blocking unit body in the direction of the gear.

* * * * *